US010780018B2

(12) United States Patent
Underwood

(10) Patent No.: US 10,780,018 B2
(45) Date of Patent: Sep. 22, 2020

(54) SQUEEZE ROLLER FOR MYOFASCIAL RELEASE

(71) Applicant: Archie Underwood, Santee, CA (US)

(72) Inventor: Archie Underwood, Santee, CA (US)

( * ) Notice: Subject to any disclaimer, the term of this patent is extended or adjusted under 35 U.S.C. 154(b) by 73 days.

(21) Appl. No.: 15/647,226

(22) Filed: Jul. 11, 2017

(65) Prior Publication Data

US 2018/0028397 A1 Feb. 1, 2018

Related U.S. Application Data

(60) Provisional application No. 62/368,124, filed on Jul. 28, 2016.

(51) Int. Cl.

| | |
|---|---|
| ***A61H 15/00*** | (2006.01) |
| ***A61H 1/00*** | (2006.01) |
| ***A61H 15/02*** | (2006.01) |

(52) U.S. Cl.

CPC ..... *A61H 15/0092* (2013.01); *A61H 1/005* (2013.01); *A61H 1/008* (2013.01); *A61H 15/02* (2013.01); *A61H 2015/0028* (2013.01); *A61H 2015/0042* (2013.01); *A61H 2015/0057* (2013.01); *A61H 2201/1253* (2013.01); *A61H 2201/1638* (2013.01)

(58) Field of Classification Search

CPC .... A61H 2015/0014; A61H 2015/0007; A61H 2015/0042; A61H 15/0092; A61H 15/0085; A61H 1/006; A61H 1/008; A61H 7/002; A61H 7/003; A61H 7/007; A61H 2007/009; A61H 15/00

See application file for complete search history.

(56) References Cited

U.S. PATENT DOCUMENTS

| | | | | |
|---|---|---|---|---|
| 1,071,998 | A | 9/1913 | Gibbs | |
| 2,221,785 | A | 11/1940 | Douglas | |
| 3,060,928 | A | 10/1962 | Lowe | |
| 3,067,738 | A | 12/1962 | Karlik | |
| 3,583,396 | A * | 6/1971 | Landis | A61H 15/0092 601/125 |
| 3,831,592 | A | 8/1974 | Lancellotti | |
| 3,957,039 | A * | 5/1976 | Ehren | A61H 15/0092 601/132 |
| 3,970,078 | A | 7/1976 | Rogers, Jr. | |
| 4,210,135 | A * | 7/1980 | Deuser | A61H 7/003 601/129 |
| 4,348,861 | A * | 9/1982 | Nakagawa | C25D 7/005 205/138 |
| 4,590,649 | A * | 5/1986 | Neilson, Jr. | A44C 5/2047 24/615 |
| D352,786 | S | 11/1994 | Hwang | |
| 5,364,338 | A | 11/1994 | Tershima | |
| 5,580,335 | A | 12/1996 | Smith, IV | |

(Continued)

FOREIGN PATENT DOCUMENTS

| | | | | |
|---|---|---|---|---|
| DE | 2412483 A1 * | 9/1975 | | A61H 15/0092 |
| WO | WO 2017/134350 A1 | 8/2017 | | |

OTHER PUBLICATIONS

Beastie Bar, downloaded from http://www.rumbleroller.com on Apr. 11, 2016.

(Continued)

*Primary Examiner* — Kristen Matter

(57) ABSTRACT

A device for redirecting force to release tension in muscles and fascia in a body part.

21 Claims, 3 Drawing Sheets

(56) References Cited

U.S. PATENT DOCUMENTS

| | | | | |
|---|---|---|---|---|
| 5,580,336 | A * | 12/1996 | Coallier | A63B 23/03533 473/614 |
| 5,858,262 | A * | 1/1999 | Lebensfeld | A63H 9/00 249/123 |
| 6,135,972 | A | 10/2000 | Kuo | |
| 6,267,738 | B1 | 7/2001 | Louis | |
| 6,315,742 | B1 | 11/2001 | Howard | |
| 7,387,599 | B1 | 6/2008 | Hsu | |
| 7,749,146 | B2 | 7/2010 | Burns | |
| 9,039,640 | B2 | 5/2015 | Crowell | |
| 9,107,795 | B2 | 8/2015 | Faussett | |
| 9,895,579 | B1 * | 2/2018 | Walterscheid | A63B 43/06 |
| 9,907,720 | B2 * | 3/2018 | Kuhne | A63B 23/0233 |
| 2001/0041851 | A1 | 11/2001 | Peyton et al. | |
| 2003/0000442 | A1 * | 1/2003 | Curchod | B29C 70/46 114/108 |
| 2003/0088198 | A1 | 5/2003 | Carpenter | |
| 2004/0049228 | A1 | 2/2004 | Lope | |
| 2006/0020232 | A1 | 1/2006 | Tien | |
| 2006/0235343 | A1 | 10/2006 | Fitzmaurice | |
| 2007/0275827 | A1 * | 11/2007 | Glaser | A63B 21/4037 482/23 |
| 2008/0287842 | A1 | 11/2008 | Benson-Gorelick | |
| 2009/0241596 | A1 * | 10/2009 | Fulkerson | A44C 5/208 63/3.1 |
| 2010/0145243 | A1 | 6/2010 | Kantor | |
| 2010/0274165 | A1 | 10/2010 | Evans | |
| 2012/0265106 | A1 | 10/2012 | Accardo | |
| 2013/0012851 | A1 | 1/2013 | Fahmie | |
| 2013/0085426 | A1 | 4/2013 | Brodsky | |
| 2013/0138024 | A1 | 5/2013 | Jennings | |
| 2013/0261517 | A1 | 10/2013 | Rodgers | |
| 2013/0291388 | A1 * | 11/2013 | Crorey | B25F 1/00 30/124 |
| 2014/0336550 | A1 | 11/2014 | Zedaker | |
| 2014/0350443 | A1 * | 11/2014 | Raines | A61H 15/0092 601/120 |
| 2015/0073321 | A1 | 3/2015 | Taylor | |
| 2015/0080774 | A1 | 3/2015 | Playa | |
| 2015/0257962 | A1 | 9/2015 | Shannon | |
| 2016/0022531 | A1 | 1/2016 | Ryan | |
| 2016/0074274 | A1 | 3/2016 | Mallory | |
| 2016/0235625 | A1 * | 8/2016 | Lee | A61H 39/04 |
| 2017/0273859 | A1 * | 9/2017 | Slocum | A61H 15/02 |
| 2018/0000684 | A1 * | 1/2018 | Burrell | A61H 15/00 |

OTHER PUBLICATIONS

CrossFit Gear-Foam Roller, downloaded from www.mensfitness.com on Apr. 11, 2016.

Double-Ball Back Roller, downloaded from www.movementfirst.sg on Apr. 14, 2016.

Gaiam Restore 12-in, Foam Roller, downloaded from www.kohls.com on Apr. 11, 2016.

KnotOut, downloaded from http://shop.theknotout.com on Apr. 11, 2016.

Cold Roller, downloaded from www.tptherapy.com on Apr. 14, 2016.

Twin Wheels AB Roller, downloaded from www.solefitness.sg on Apr. 11, 2016.

Screenshots of HighBaller campaign on Kickstarter, downloaded Mar. 1, 2018.

* cited by examiner

SQUEEZE ROLLER FOR MYOFASCIAL RELEASE

CROSS-REFERENCE TO RELATED APPLICATIONS

This application claims the benefit of priority of provisional application 62/368,124, filed Jul. 28, 2016, the contents of which are incorporated herein in its entirety.

TECHNICAL FIELD

This invention relates to devices for applying therapeutic pressure to parts of the body, more specifically to release tension in muscles and fascia.

SUMMARY OF THE INVENTION

This invention provides a device to redirect force to a body part, such as to release tension in muscles and fascia. In one embodiment, the device can have a first and a second roller and a tensioning means so that exerting force from a body part to the device will redirect force from the rollers toward the body part. The rollers can be customized and replaced for particular properties as desired. The invention also provides optional components, such as a rolling mat configured for the rollers. The invention further provides methods for using the device on oneself or with another, and for replacing the rollers.

DETAILED DESCRIPTION OF THE INVENTION

Figure 1A:
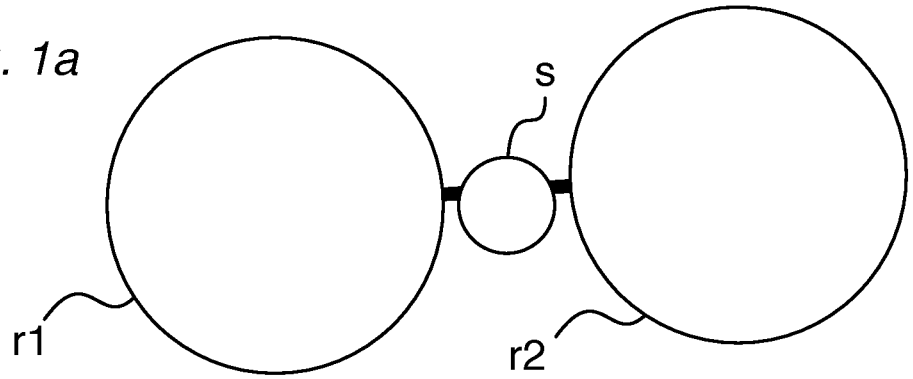
FIG. 1*a* shows a representative device having two rollers (r1, r2) and an optional spacer element (s).
Figure 1B:
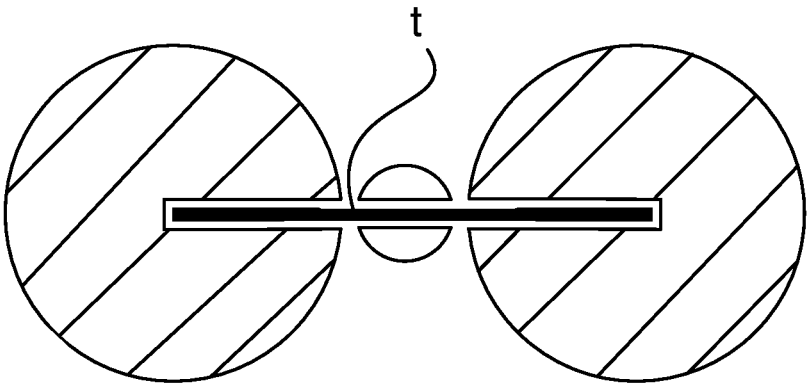
FIG. 1*b* shows a cross-section of the embodiment in FIG. 1*a*, with a representative tensioning means (t) shown between the rollers.

This invention provides a device for redirecting force to a body part, such as to release tension in muscles and fascia. In one embodiment shown in FIG. 1*a*, the device can have a first roller element (r1) connected to a second roller element (r2). The rollers can be held a predetermined distance apart via a flexible tensioning means (t), which may include an optional spacer element (s). The tensioning means can be attached to the rollers or pass through the rollers and through the optional spacer, as shown in the cross-section of FIG. 1*b*.

Figure 2:
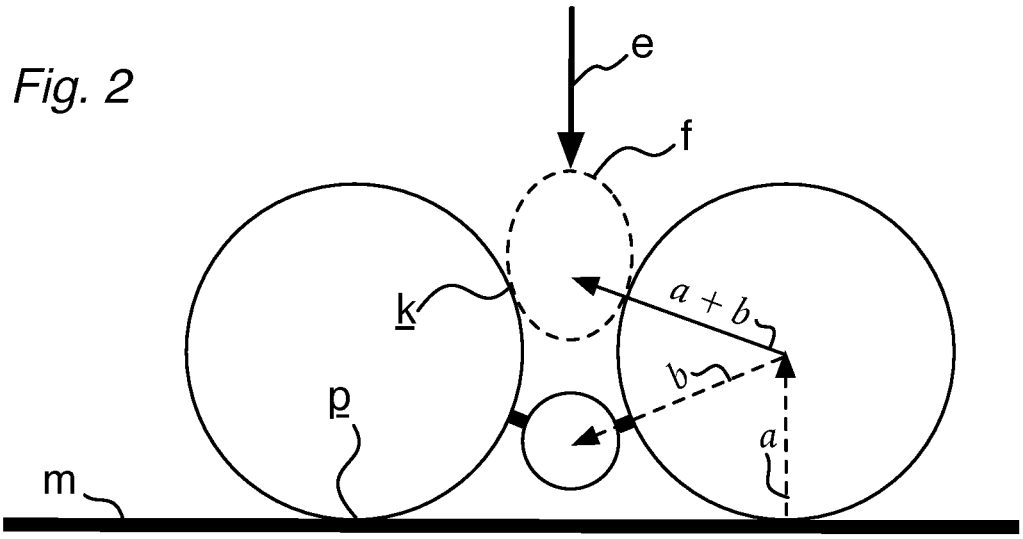
FIG. 2 shows the embodiment of FIG. 1*a* where a body part (f), such as a forearm, is pressed downward (e) at a contact surface (k) of the roller toward a surface (m), such as a mat on the floor. The roller contacts the surface at pivot surface (p) and is allowed to pivot relative to the body part. As an example, opposing forces from the floor (a) and tension (b) communicated through the tensioning means causes the rollers to press inward (a+b) to squeeze the body part.
Figure 3:
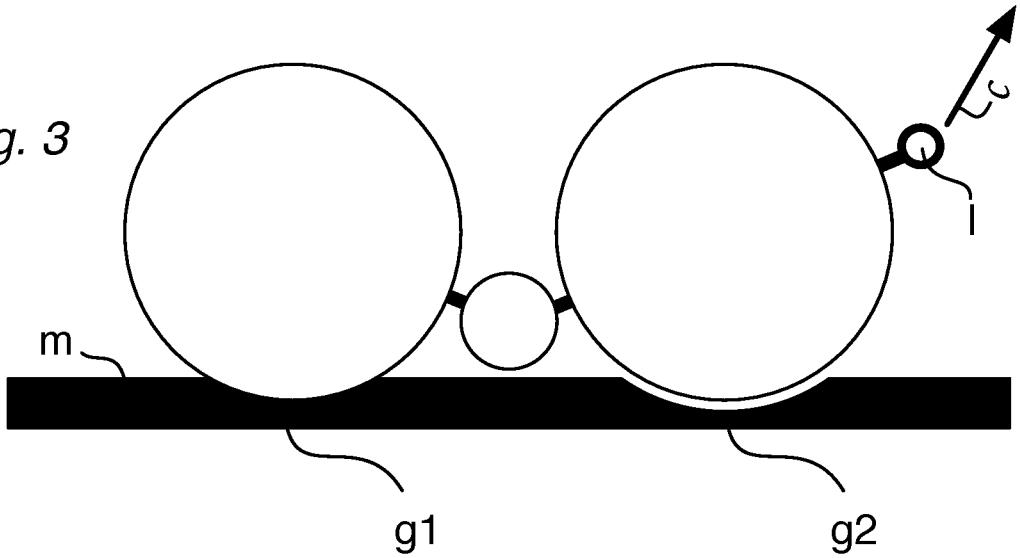
FIG. 3 shows a device on a mat (m) that is compressible and forms a groove (g1) under pressure or where a roller fits into an existing groove (g2). An optional linkage (1) is shown so supplemental tension (c) can be applied to the device.

For purposes of introductory orientation, a user can position a body part (f), such as a forearm or calf, between the rollers and press downward toward a surface (e), such as a floor or mat (m). The force is applied directly to the tensioning means (t) or indirectly via the rollers (r1, r2). It is believed that the opposing force components from the mat (a) are additive with the tension via the tensioning means (b) to exert force to squeeze the body part (a+b), as shown in FIG. 2. When the rollers are maintained in precise coordination as disclosed herein, the applied force is redirected to the body part with surprising effectiveness to muscles, fascia, and trigger points. The redirected force can also be applied along the body part by optionally rolling the device along the floor or mat (m). Accordingly, the device enables the user to pinch and roll the surface of a body part to provide precise relief.

Rollers

As used herein, a "roller" is a substantially solid object of any shape that has a pivot surface and a contact surface. The pivot surface (p) of a roller is a portion that can be rounded, meaning that at least a portion of the surface is generally convex to allow the roller to pivot in contact with the surface (m). The pivot surface can be relatively pointed to act as a fulcrum so the roller pivots relative to the surface where the tip of fulcrum stays substantially in place. A somewhat more pointed pivot surface is shown as p6. Portions of the pivot surface can be flat or concave, as long as the pivot surface as a whole or its edge remains in contact with the floor or mat surface. This pivot motion relative to the surface does not exclude the ability of the roller element to roll with respect to a different axis: it is envisioned that many rollers will have a generally circular cross-section to facilitate rolling motion. The rolling motion can be performed while applying force, thus combining rolling and pivoting motions. Examples of such rollers include substantially spherical, ellipsoidal, conical, and cylindrical shapes, or combinations thereof.

The contact surface of a roller (k) is the portion that contacts the body part. Where a roller is spherical, the contact surface will be radially convex. Other useful devices have rollers where the profile of the contact surface is flat or concave to provide a geometry for distributing force more evenly to the body part. Where more concentrated pressure is desired, the contact surface can be more convex, for example a ridge or a series of points. The contact surface can also have a patterned surface, such as a dimpled or bumpy surface.

The rollers can roll together in coordination around the tensioning means of a device. They can also rotate independently of each other, allowing a body part to roll in different orientations relative to the floor or mat. In this configuration, for example, a user's back can lie on the device and roll linearly and rotationally at different angles to squeeze different points on the back from different directions.

Roller Properties

Individual rollers can be provided with desired properties, such as color, size, relative firmness, or resistance to surface liquids. The surface of a roller can have convex dimples or concave depressions of varying size and distribution. A roller can have a relatively thin exterior layer that is firmer or less compressible than the interior of the roller, such as a foam core. Useful foams include polyurethane and other thermoplastic elastomers. A roller can also have a softer outer surface around a firmer core, which can be solid plastic, rubber, wood, or even metal. Rollers can incorporate additional substances, for example plant-derived materials such as oils or inorganic minerals, for functional effect when in contact with the body part.

A roller can have selected thermal properties to retain cold or heat, or to dissipate or transfer body heat, such as to other surfaces. A roller can contain material that can be chilled by contact, such as immersion in cold or ice water, or heated by immersion in hot water. A particular combination has one hot roller and one cold roller ("fire and ice") that can be used in alternating orientations for thermal cycling. A roller can be microwaveable or can have a heating element that is powered by an internal battery (rechargeable or replaceable) or by an external power source. The battery or power source can also be used to power an internal element that provides vibration to the body part of varying speed, rhythm, and intensity (such as ultrasound or infrared) to supplement the squeezing action. Where power is to be supplied to the roller, it can be through a rotatable coupling, or through induction charging. More simply, vibration can be generated where a roller has a solid or liquid weight that is allowed to tumble within an internal chamber as the roller is moved.

Tensioning Means

The tensioning means is any physical object that substantially keeps the rollers within a predetermined range of distances apart. The means should not allow the rollers to separate completely from each other, but should maintain some tension and spacing between the rollers. The means may allow the rollers to come quite close together but still separate to provide the desired squeezing action when a body part is applied. The means are also flexible enough to permit the rollers to pivot at the pivot surface (p) in use, and, if desired, for the rollers to roll on a surface.

A roller can be attached to tensioning means by having the means pass through the interior of a roller or by attachment to one or more surfaces of the roller. Tensioning means can include a flexible rod, a rope, chain, cable or hose. The means can be any material, such as metal, plastic, or rubber. The means can have a protective coating to avoid snagging a body part such as hair. In some embodiments, the end of a rod can be threaded, form a loop, or other attachment point (e) such as a hook, eyelet, eye bolt, U-bolt or shackle. The end of the tensioning means can be flared or crimped, such as by a nicopress-type compression sleeve, or a crimping or swaging tool.

The tensioning means can include one or more terminal elements to prevent the rollers from separating too far under pressure. Typical terminal elements include a threaded nut or end cap, a clamp, an enlarged area such as an anchor, clip, grip, snap, shackle, or bracket. A terminal element can be a hitch, hairpin, or pin clip. Preferably the terminal element has a quick release component for easy replacement of a roller by hand without the use of tools.

The means can also have one or more spacer elements (s) to help keep the rollers a minimum distance apart. The spacer element can be a smaller version of the other rollers. The tensioning means can include elements such as a washer, grommet, O-ring, coupling nut, spring, bracket, or other spacer elements in various combinations.

The tensioning means can have a threaded end (like the end of a bolt) to allow an end cap to be tightened or loosened or removed. This can also allow selected individual rollers to be removed or replaced to be customized to the dimensions of a user's body parts, the desired degree and direction of pressure.

As noted above, the tensioning means can have an attachment point for another element, such as a handle, a strap, or loop (l), made of any material. One or more handles can be useful for applying additional tension (c) to the rollers when used by oneself or with the assistance of another. The effect of directed tension can be a contrast to the pressure applied by a conventional roller stick.

A strap can be used to fix the device temporarily to another object, such as a wall, ceiling, or floor fixture, or to different parts of a door, to provide additional leverage. A pulley can also be used with a fixture to provide extra force to the rollers. A strap can be attached to both rollers and placed around another body part, such as a leg, or around the body of the user to control the level of pressure exerted by the rollers. The strap can be secured around a prosthetic, knee roller, a walker, or a wheelchair for extra effect. Hardware for securing a strap can be included with the device.

The attachment point can also be used to store the device by hanging on a wall hook, for example. Another storage method is to place the device in a relatively cylindrical container, which may be padded or ventilated, for personal transportation or commercial shipping.

Some users may prefer to use a covering over the device to provide a softer or more absorbent surface without affecting the force properties of the device. The covering on a device may be replaced prior to or after use by others, or sanitized before or after use.

Mat

Figure 4:
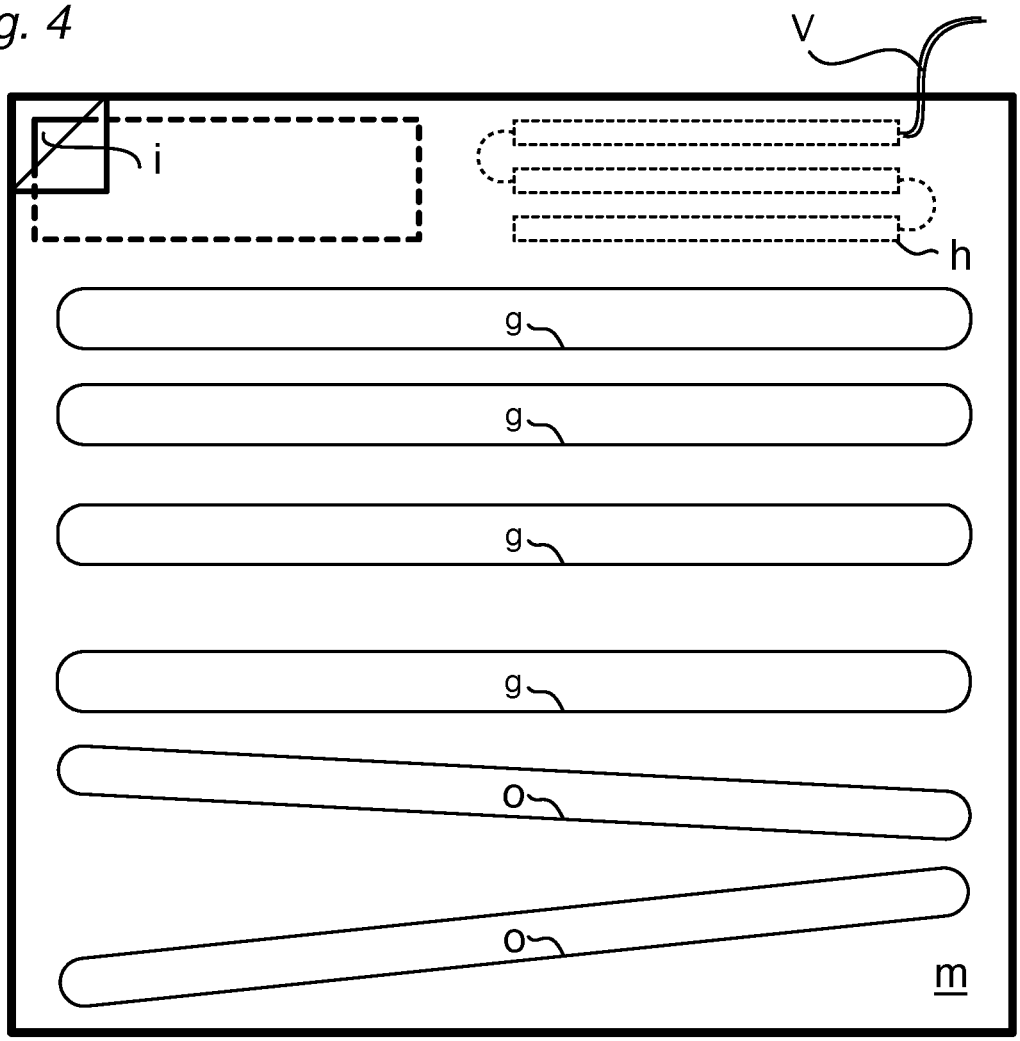
FIG. 4 shows a top view of a mat surface (m) with various optional features. A mat can have a thermal block, such as pouched ice (i) between mat layers. A mat can have a cooling or heating element (h) inserted within the mat layers that optionally connect to a power supply (v). A mat can have one or more grooves (g) of varying spacings apart where the rollers can be rolled, or oblique grooves (o) to vary the squeezing force as the device is rolled by the user along the grooves.
Figure 5:
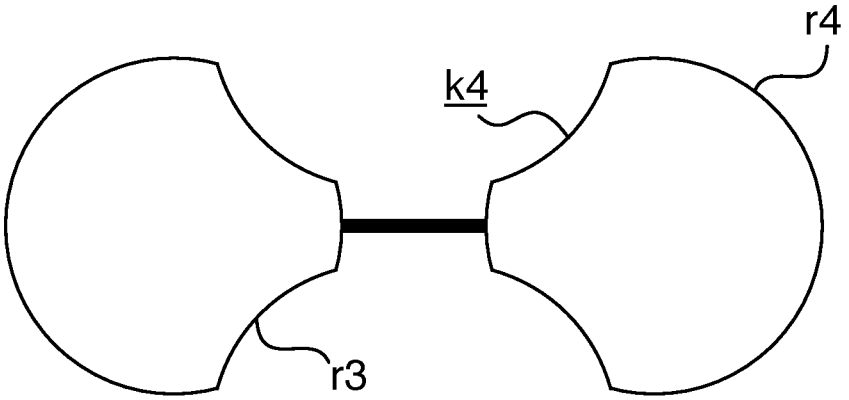
FIG. 5 shows another embodiment of the invention with rollers r3 and r4. As shown, roller r4 has a generally concave contact surface (k4).
Figure 6A:
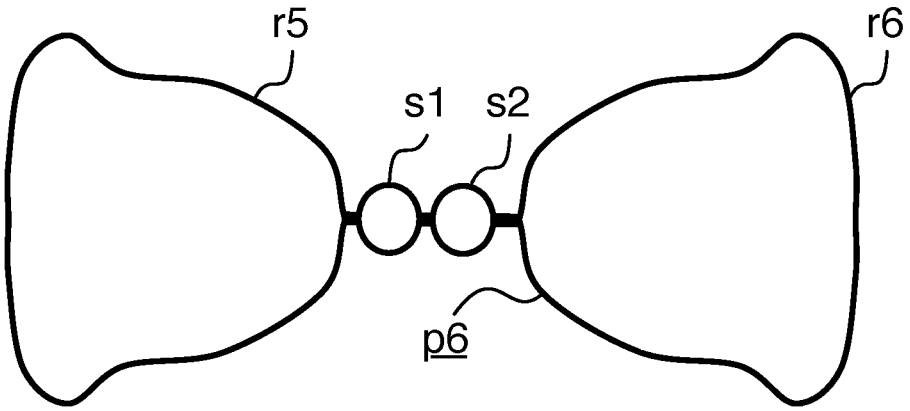
FIG. 6*a* shows yet another embodiment with bell-shaped rollers r5 and r6, and two of the optional spacers (s1, s2).
Figure 6B:
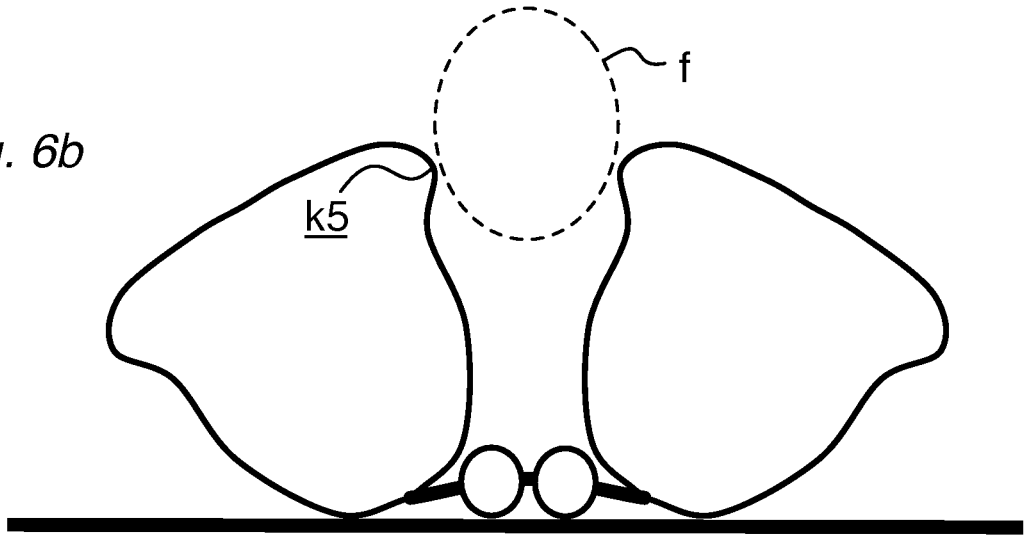
FIG. 6*b* shows this embodiment where body part f presses the rollers against their contact surfaces (such as k5 of r5).

An optional mat (m) can be provided that has desired properties, such as flexibility under pressure, so it compresses under the pressure of a roller to form a groove (g1). The mat can also be relatively noncompressable or provided with grooves (g2) to receive one or more rollers. Such grooves can be used to maintain the rollers at a predetermined range of distances to permit contacting a body part between the rollers while allowing the rollers to pivot towards each other. Two or more grooves (g) can be substantially parallel, separated by varying distances, as shown in FIG. 4. Grooves can also be positioned in a nonparallel orientation to be relatively oblique to each other (o) to vary the distance between r1 and r2, thereby intensifying or easing the squeezing effect while rolling.

The mat can have the features and properties already described above for rollers. For example, the mat can have different layers of materials for varying compressibility and firmness. A mat can have a portion that provides heat and cold to the user's body part, or to transfer the heat or cold to a roller. For example, the mat can have an internal pocket or sleeve that allows insertion of a thermal block, such as a watertight container of ice (i) or heating pouch. The mat can have a cooling or heating element (h) that serves as a cooling or heating pad for a roller, and can be supplied by external power source (v).

The mats described herein can be provided or used with the roller device as a complementary component. The mats can also be provided and used independently for its own properties without requiring combination with the roller device. For example, a heated or cooled mat can be used during stretching or yoga to provide heating or cooling directly to the user's body. The use of the mat can be before, during, or after using the roller device.

The device can be provided as part of a system of components, such as alternate or replacement rollers or tensioning means of differing lengths, flexibility, or elasticity. The system can have the mat described above, or instruction materials, such as written instructions, or audio or visual of software training media. Instructional diagrams can be illustrated on the mat itself. The system can include components for attachment to the rollers, such as a hook, a carabiner, a handle or grip, a strap, or a cable for attachment to other objects.

Methods

The invention provides a method for assembling the device from component rollers and tensioning means. The invention includes methods for using the device by positioning a body part between the rollers applying force to the tensioning means. As a result, the force is redirected toward the body part from the directions of the rollers. The user can also roll the body part between the rollers. The body part can be any part of the body, including upper and lower limbs, and particularly a forearm or a lower leg. The force can be applied by another person (c), and the other person can provide the surface for other forces (a).

In a particular embodiment, the device is used in a series of rolling steps that begin with one part of the body and continues to another part, optionally rolling all limbs of the user's body, from different directions, and preferably in a predefined order of steps. When the device is consistently positioned between the user's body and a surface, such as a wall or floor, the execution of ordered steps can involve considerable focus, balance, limb and core strength to maintain the device in optimal positions during the steps.

The rollers can be replaced by loosening the tensioning means; removing a roller; adding a different roller; and re-tensioning the tensioning means to allow sufficient slack to allow the rollers to pivot toward each other.

Skilled artisans will appreciate that additional embodiments are within the scope of the invention. The invention is defined only by the following claims, and limitations from the specification or its examples should not be imported into the claims.

I claim:

1. A device for redirecting force to a body part, comprising:

a first and a second rounded roller;

a flexible, inelastic first tensioning means to maintain the rollers within a predetermined distance apart to permit contacting a body part between the rollers, while allowing the first tensioning means to flex so that the rollers pivot towards each other; and an attachment point at each end of the first tensioning means for preventing the rollers from separating beyond the predetermined distance along a straight line;

wherein the first tensioning means is selected from the group consisting of a rope, a chain, and a metal cable, whereby exerting force between the body part and the first tensioning means redirects the force from the rollers toward the body part.

2. The device of claim 1, wherein at least one of the first or the second roller is substantially ellipsoid, or cylindrical, or a combination thereof.

3. The device of claim 1, wherein an exterior of at least one of the first or the second roller is relatively compressible.

4. The device of claim 1, wherein the first tensioning means comprises a metal cable.

5. The device of claim 1, wherein the first tensioning means further comprises a terminal eyelet.

6. The device of claim 1, wherein the first tensioning means has a hook or handle.

7. The device of claim 1, wherein the first tensioning means allows replacement of at least one of the first or the second roller.

8. A system comprising the device of claim 1, further comprising alternate rollers having different properties.

9. The device of claim 1, further comprising a removable covering.

10. The device of claim 1, further comprising at least one spacer positioned between the first and the second rollers.

11. The device of claim 1, wherein at least one of the first or the second rollers is substantially conical and has a convex contact surface.

12. The device of claim 1, wherein at least one of the first or the second rollers is bell-shaped.

13. The device of claim 1, wherein the first tensioning means is metal.

14. The device of claim 1, wherein the first tensioning means has at least one threaded end.

15. The device of claim 1, wherein the first tensioning means has at least one end that is crimped or swaged.

16. A system of components comprising the device of claim 1, and further comprising an alternate tensioning means that has a different length than the first tensioning means, whereby the alternate tensioning means maintains the rollers within an alternate predetermined distance apart.

17. A system of components comprising the device of claim 1 and further comprising a mat, wherein the mat has grooves to receive the rollers, and wherein the grooves are positioned in a nonparallel orientation to be relatively oblique to each other while allowing the rollers to pivot toward each other.

18. The device of claim 1, wherein the first tensioning means has at least one end that further comprises a quick release component.

19. The device of claim 1, wherein the first tensioning means comprises a rope.

20. The device of claim 1, wherein the first tensioning means comprises a cable.

21. The device of claim 1, wherein the number of rollers is two.

* * * * *